US012680551B2

(12) United States Patent
Fu

(10) Patent No.: US 12,680,551 B2
(45) Date of Patent: Jul. 14, 2026

(54) FAN BLADE QUICK INSTALLATION STRUCTURE AND A FAN USING THE SAME

(71) Applicant: Zhongshan Shengyi Electric Appliance Co., Ltd., Zhongshan (CN)

(72) Inventor: Yonghong Fu, Zhongshan (CN)

(73) Assignee: Zhongshan Shengyi Electric Appliance Co., Ltd., Zhongshan (CN)

( * ) Notice: Subject to any disclaimer, the term of this patent is extended or adjusted under 35 U.S.C. 154(b) by 0 days.

(21) Appl. No.: 18/928,853

(22) Filed: Oct. 28, 2024

(65) Prior Publication Data

US 2025/0207606 A1 Jun. 26, 2025

(30) Foreign Application Priority Data

Dec. 25, 2023 (CN) ..... 202311795639.9

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01)

(58) Field of Classification Search
CPC ..... F04D 25/088; F04D 29/34
See application file for complete search history.

(56) References Cited

U.S. PATENT DOCUMENTS 6,309,183 B1 * 10/2001 Bucher ..... F04D 29/34 416/207
6,692,233 B2 * 2/2004 Liang ..... F04D 29/34 416/220 A
6,916,156 B2 * 7/2005 Tseng ..... F04D 29/34 403/324
7,008,192 B2 * 3/2006 Hidalgo ..... F04D 29/34 416/220 A
12,180,973 B1 * 12/2024 Chen ..... F04D 25/088
2002/0027183 A1 * 3/2002 Tseng ..... F04D 29/34 248/220.21
2004/0265131 A1 * 12/2004 Tseng ..... F04D 25/088 416/206
2017/0350414 A1 * 12/2017 Wang ..... F04D 25/088

FOREIGN PATENT DOCUMENTS

CN 117662520 A * 3/2024 ..... F04D 29/388

* cited by examiner

*Primary Examiner* — Helena Kosanovic
*Assistant Examiner* — John S Hunter, Jr.
(74) *Attorney, Agent, or Firm* — JEEN IP LAW, LLC

(57) ABSTRACT

The present invention discloses a fan blade quick installation structure, comprising a turntable and a fan blade body, the periphery of turntable is provided with a slot, and the slot side of turntable is provided with a movable locking device having an operating portion that extends out of the turntable, the locking device has a tendency to enter the slot to approach the fan blade body, the root side of fan blade body is provided with a locking position, and there are two states between the fan blade body and the locking device. The fan blade body and turntable in the ceiling fan of the present invention can be conveniently and easily assembled and disassembled without the use of tools.

8 Claims, 7 Drawing Sheets

FAN BLADE QUICK INSTALLATION STRUCTURE AND A FAN USING THE SAME

CROSS-REFERENCE TO RELATED APPLICATIONS

This application claims priority to Chinese Patent Application No. 202311795639.9, filed on Dec. 25, 2023, which is hereby incorporated by reference in its entirety.

TECHNICAL FIELD

The present invention relates to the field of fan technology, particularly to a fan blade quick installation structure and a fan using the same.

BACKGROUND

At present, ceiling fans on the market comprise a turntable and several fan blades, which are fastened together by a plurality of bolts. In order to reduce volume, the fan blades and turntable are separated when a ceiling fan is packaged for transport, and users need to assemble them themselves using appropriate tools. This type of ceiling fan can be disassembled and assembled without the use of tools.

SUMMARY

The purpose of the present invention is to provide a fan blade quick installation structure that can be assembled and disassembled without the use of tools.

The purpose of the present invention is achieved as follows

- a turntable, the periphery of turntable is provided with a slot, and the slot (10) side of turntable is provided with a movable locking device having an operating portion that extends out of the turntable, the locking device has a tendency to enter the slot to approach the fan blade body,
- a fan blade body, the side of the root of fan blade body is provided with a locking position, and
- there are two states between the fan blade body and the locking device:
- the first state: when the fan blade body is connected to the turntable, the root is inserted into the slot, the locking device and corresponding locking position limit each other to lock the root in the slot;
- the second state: when the fan blade body is separated from the turntable, external force drives the locking device to move along with the operating portion, so that the locking device disengages from the locking position, the root detaches from the slot to release the operating portion and reset the locking device. The fan blade body and turntable in the ceiling fan of the present invention can be conveniently and easily assembled and disassembled without the use of tools.

The above technical solution can be further improved as follows.

In a more specific solution, the locking device comprises a rotating member and an elastic member, the rotating member and turntable are rotatably connected, the rotating member extends out of limiting portion and operating portion, the limiting portion and locking position are mutually limited, and the two ends of elastic member are respectively in contact with the limiting portion and turntable, the elastic force of elastic member causes the limiting portion to enter the slot and approach fan blade body until the operating portion and the turntable are mutually limited. The elastic member causes the rotating member to rotate, which means that the limiting portion will be stuck in the locking position and at the same time, the operating portion is pressed against the turntable to prevent the rotating member from continuous rotation, ensuring that the limiting portion and locking position are mutually limited to withstand the centrifugal force from the rotating fan blade body.

In a more specific solution, the turntable is provided with an installation groove on one side of the slot, the locking device is rotatably disposed in the installation groove that is connected to the slot, and the elastic force of elastic member causes limiting portion to enter the slot from the installation groove, or the operating portion causes the limiting portion to overcome the elastic force of elastic member and to retract back into the installation groove from the slot. The installation groove facilitates the rotation and installation of locking device.

In a more specific solution, a limiting hole is provided on the circumferential surface of turntable corresponding to the installation groove, the operating portion extends out of the turntable through the limiting hole, and when the elastic force of elastic member causes the limiting portion to enter the slot from the installation groove until the operating portion is in contact with one side wall of the limiting hole, the operating portion moves towards the other side wall of the limiting hole to drive the rotating member to rotate, so that the limiting portion overcomes the elastic force of elastic member and returns into the installation groove from the slot. The operating portion restricts the movement range of locking device.

In a more specific solution, the installation groove is provided with a first positioning portion, the side of limiting portion facing away from the root is provided with a second positioning portion, the elastic member is a spring, and one end of elastic member is sleeved on the first positioning portion to maintain positioning fit, and the other end of elastic member is sleeved on the second positioning portion to maintain positioning fit. The elastic member is easy to install and operates stably and reliably.

In a more specific solution, the end face of turntable is provided with a hollow part connected to the installation groove, the installation groove is provided with a positioning screw, the rotating member is provided with a through hole, the rotating member is threaded on the positioning screw through the through hole, the screw and positioning screw are thread connected, and the nut of screw restricts the rotating member to the positioning screw, and the rotating member rotates around the positioning screw. The locking device is easy to install.

In a more specific solution, a convex portion is further provided on the side of the root of fan blade body, and the convex portion and locking position are disposed along the inner end of root toward the outer end and, when the root is inserted into the slot, the convex portion comes into contact with the limiting portion, and along with the insertion of root, the convex portion causes the locking position to exit the slot until the convex portion disengages from the limiting portion, and the elastic force of elastic member causes the limiting portion to be inserted into the locking position.

In a more specific solution, in the first state, the locking device applies force to the fan blade body on the side opposite to locking device through the locking position, and the fan blade body is in contact with the slot in the direction away from the locking device. The connection between the fan blade body and the turntable is more secure.

In a more specific solution, a guide groove is provided on the side of slot along the insertion direction of root, and the guide groove avoids the locking device, a positioning convex strip is provided on the side of the corresponding root along the insertion direction of root, and the positioning convex strip avoids the locking position and is inserted into guide groove to guide the root into the slot, and the locking device makes the positioning convex strip in contact with the guide groove away from the locking device. The guide groove and positioning convex strip facilitate the directional insertion of root into the groove, and the locking device stably and reliably locks the root and, at the same time, bears the torque when the turntable drives the fan blade body to rotate, avoiding the locking device from being subjected to force. The locking device operates stably and reliably, with a long service life.

The purpose of the present invention is to provide a fan with fan blades that can be assembled and disassembled without the use of tools.

The purpose of the present invention is realized in this way.

A fan comprising the aforementioned fan blade quick installation structure.

The present invention has the following beneficial effects.

(1) The fan blade body and turntable in the ceiling fan of the present invention can be conveniently and easily assembled and disassembled without the use of tools.

(2) The elastic member causes the rotating member to rotate, which means that the limiting portion will be stuck in the locking position and at the same time, the operating portion is pressed against the turntable to prevent the rotating member from continuous rotation, ensuring that the limiting portion and locking position are mutually limited to withstand the centrifugal force from the rotating fan blade body. Elastic member is easy to install and operate stably.

(3) The operating portion restricts the movement range of locking device and also facilitates users to control the locking device to release the fixing of fan blade body through the operating portion, so that the fan blade body can be easily disassembled.

(4) The guide groove and positioning convex strip facilitate the directional insertion of root into the groove, and the locking devices on both sides stably and reliably lock the root and, at the same time, bear the torque when the turntable drives the fan blade body to rotate, avoiding the locking device from being subjected to force. The locking device operates stably and reliably, with a long service life.

DESCRIPTION OF EMBODIMENTS

Figure 1:
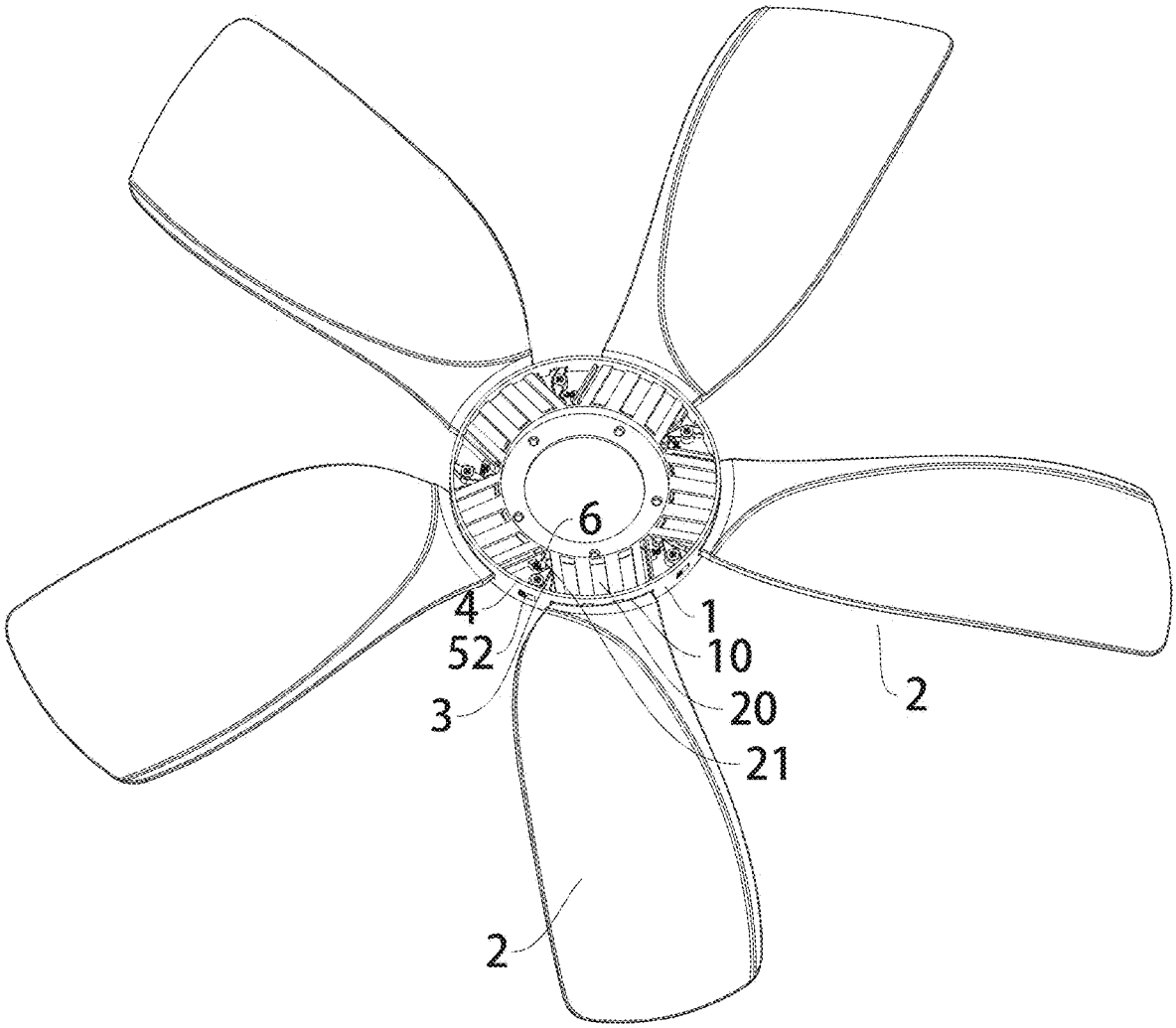
FIG. 1 is a structural schematic diagram of Embodiment 1.
Figure 2:
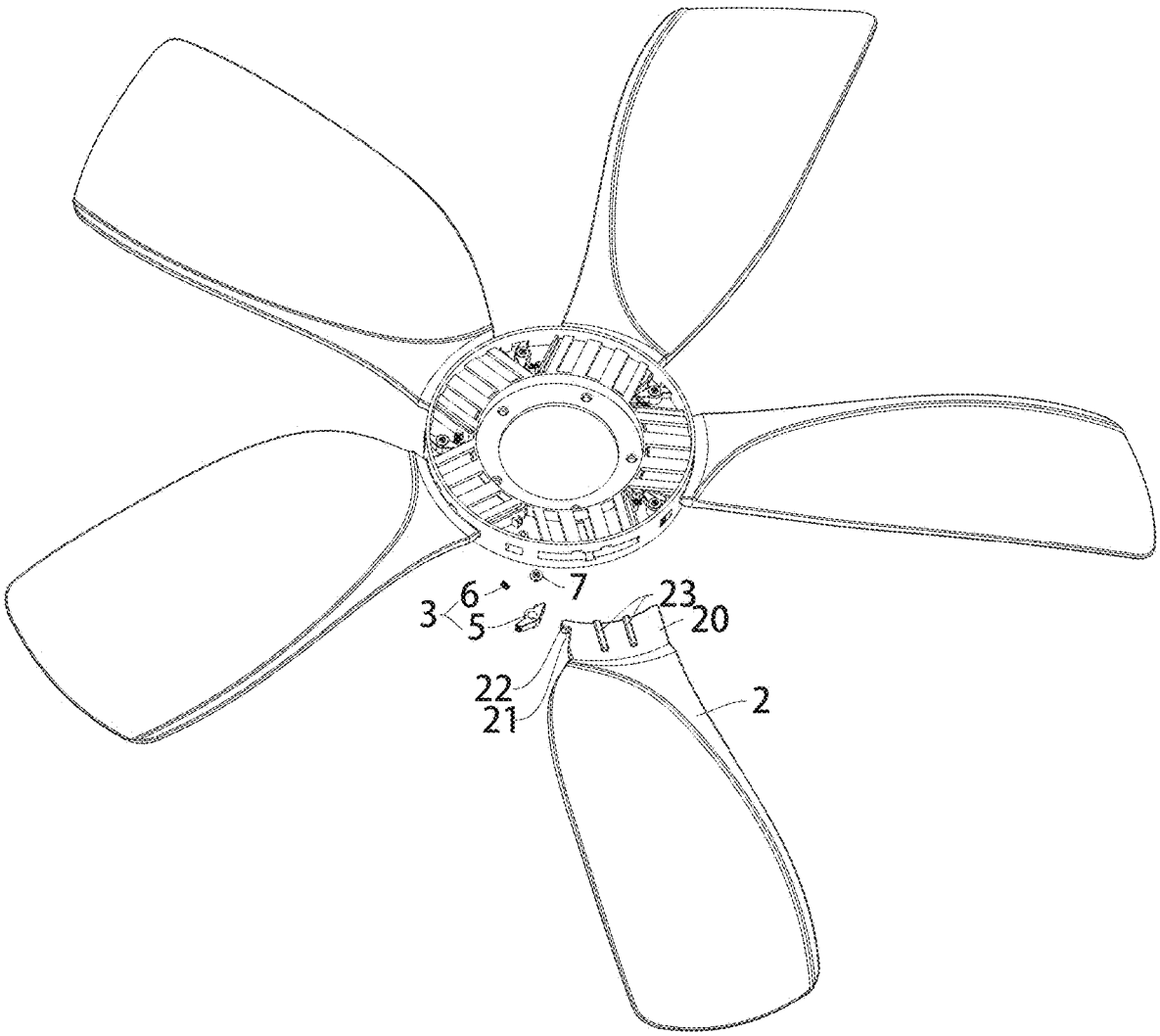
FIG. 2 is a schematic diagram of the decomposition structure of Embodiment 1.
Figure 3:
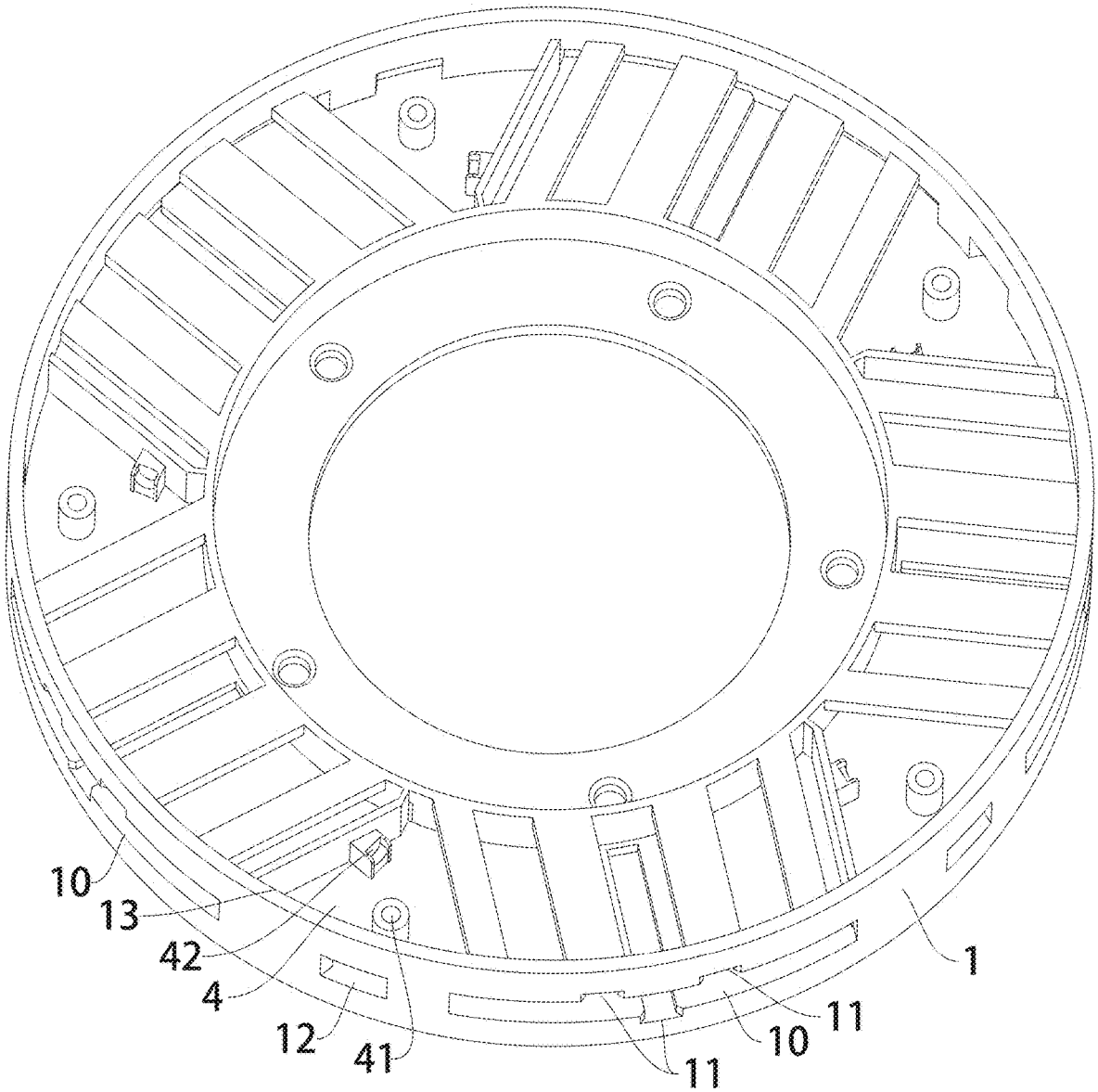
FIG. 3 is a structural schematic diagram of the turntable in Embodiment 1.
Figure 4:
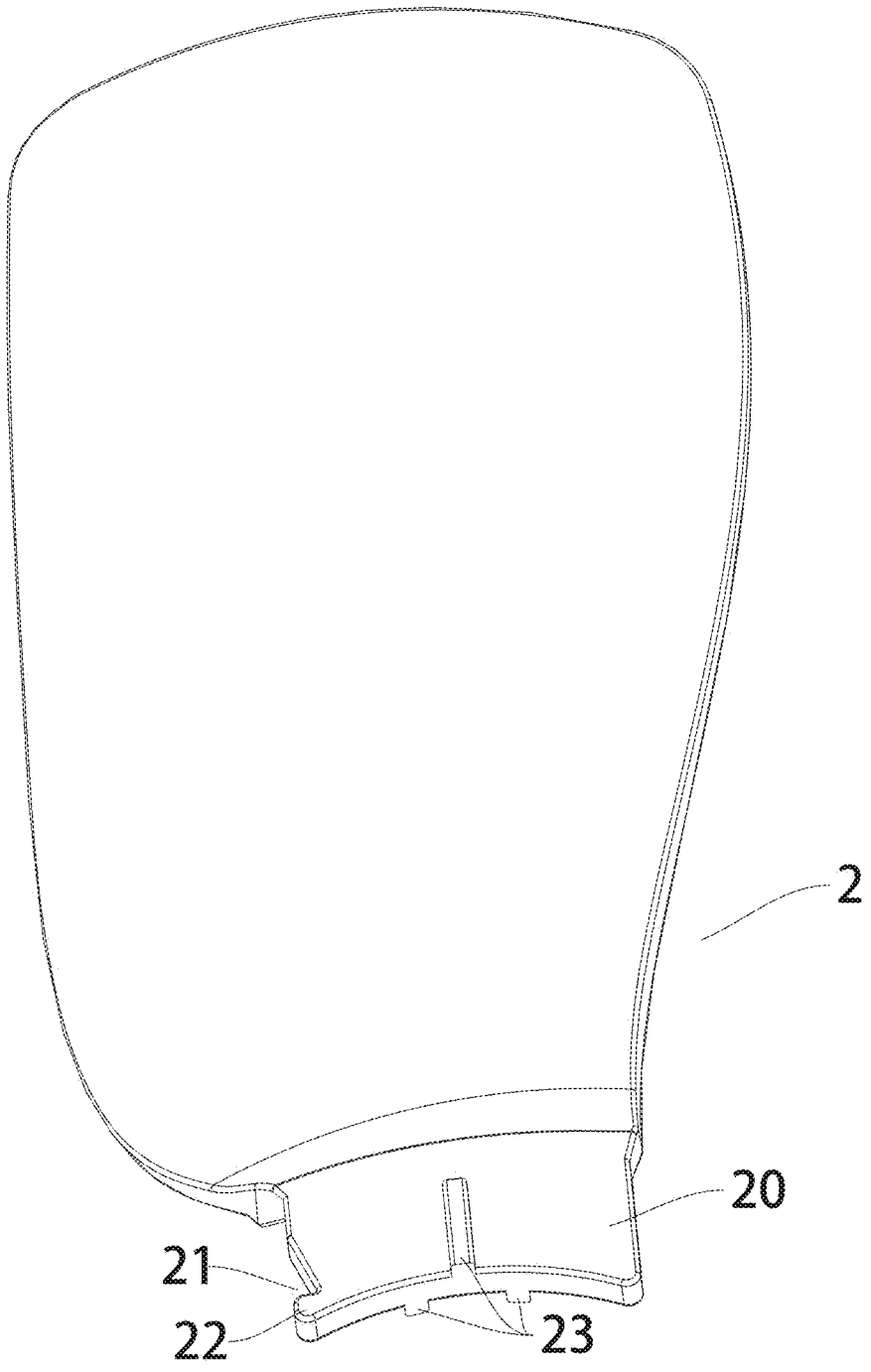
FIG. 4 is a structural schematic diagram of the fan blade body in Embodiment 1.
Figure 5:
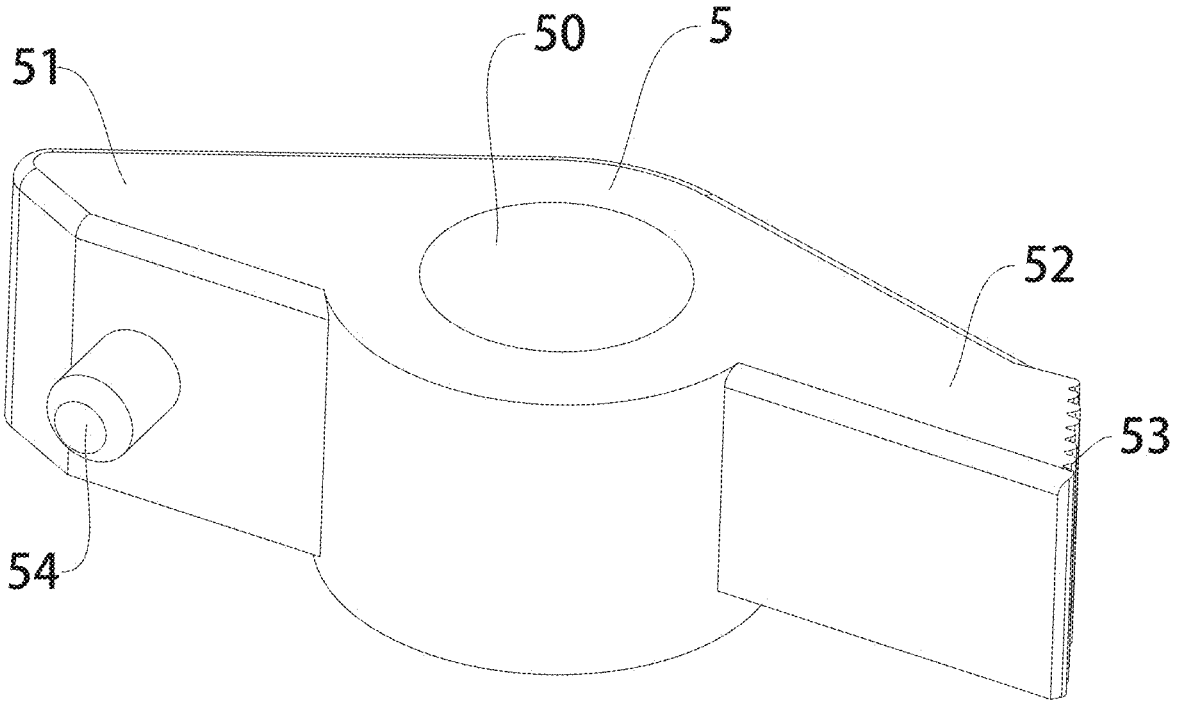
FIG. 5 is a structural schematic diagram of the rotating member 5 in Embodiment 1.
Figure 6:
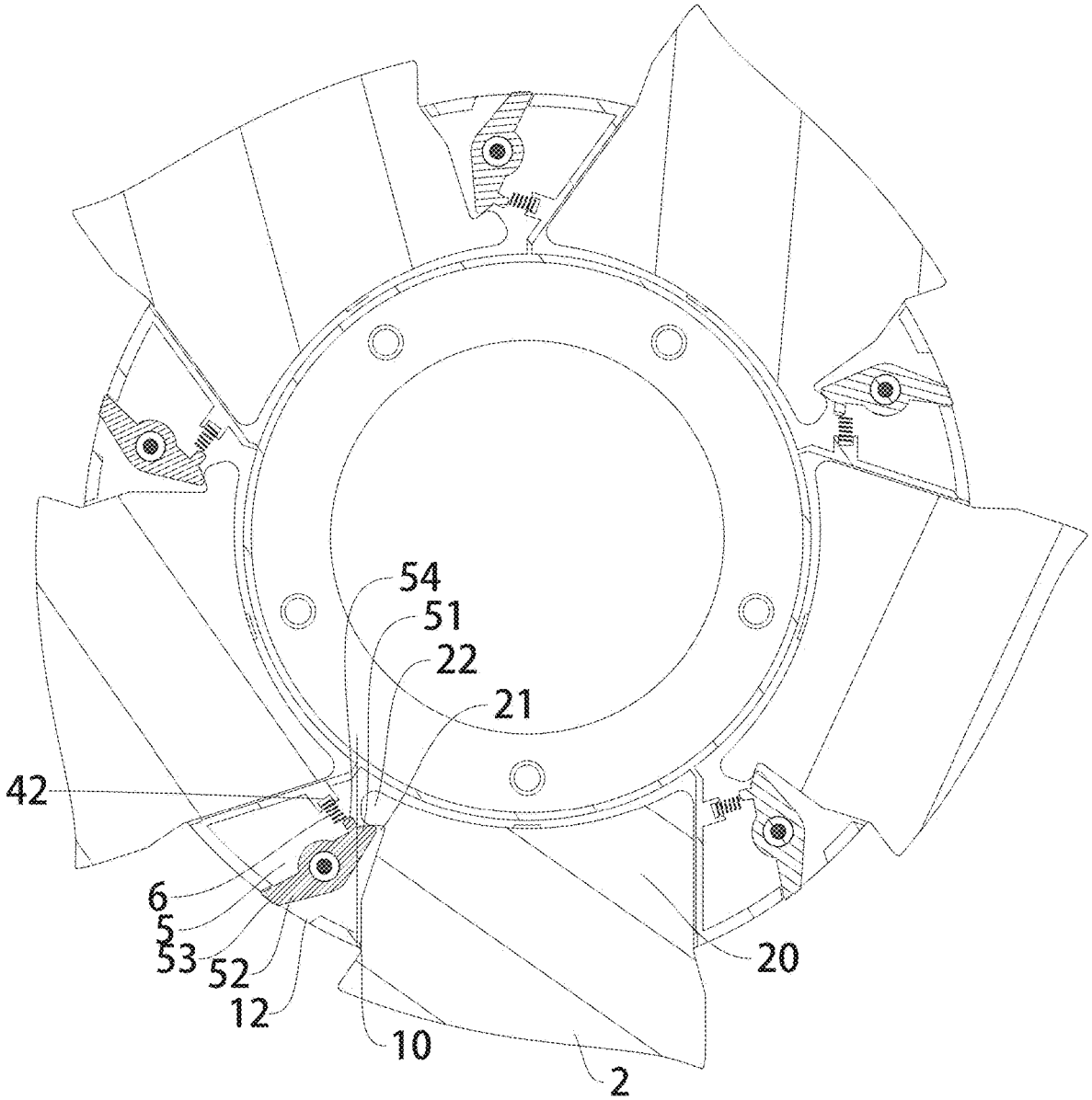
FIG. 6 is a schematic diagram of the partial cross-sectional structure of Embodiment 1 (first state).
Figure 7:
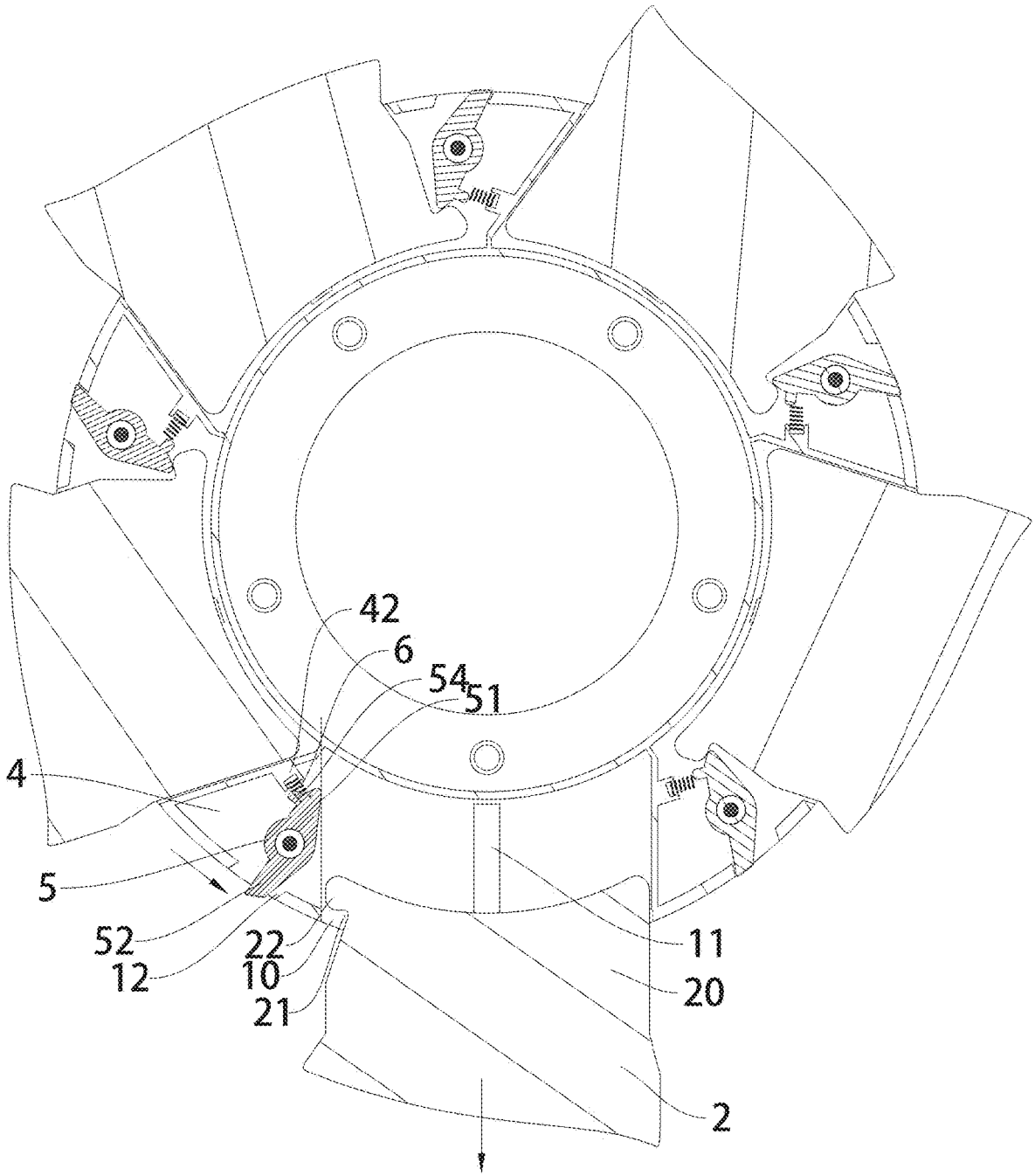
FIG. 7 is a schematic diagram of the partial cross-sectional structure of Embodiment 1 (second state).

The present invention will be further described in conjunction with the accompanying drawings and embodiments.

In Embodiment 1, as shown in FIG. 1-7, a fan blade quick installation structure comprises a turntable 1, a fan blade body 2, and a locking device 3. A plurality of slots 10 are evenly distributed on the circumference of the turntable 1, and the number of slots 10 corresponds to that of fan blade body 2. Each slot 10 is provided with an installation groove 4 on the side, which is connected to the slot 10, and each installation groove 4 is provided with a movable locking device 3. The top and bottom surfaces of slot 10 are, along the insertion direction of root 20, provided with guide grooves 11 that avoid the locking device 3. In this embodiment, the number of guide grooves 11 on the top and bottom surfaces of slot 10 is different and disposed in staggered positions.

A limiting hole 12 is provided on the circumferential surface of turntable 1 corresponding to the installation groove 4, the end face of turntable 1 is provided with a hollow part 13 connected to the installation groove 4, and the locking device 3 is installed in the installation groove 4 through the hollow part 13. The installation groove 4 is provided with a positioning screw (41), and the locking device 3 is rotatably disposed on the positioning screw 41.

The locking device 3 comprises a rotating member 5 and an elastic member 6. Rotating member 5 is rotatably connected to turntable 1, with rotating member 5 extending beyond limiting portion 51 and operating portion 52. Specifically, the rotating member 5 is provided with a through hole 50, the rotating member 5 is threaded on the positioning screw 41 through the through hole 50, the screw 7 and positioning screw 41 are thread connected, and the nut of screw 7 restricts the rotating member 5 to the positioning screw 41, and the rotating member 5 rotates around the positioning screw 41.

The operating portion 52 extends out of the turntable 1 through the limit hole 12. The two ends of elastic member (6) are respectively in contact with the limiting portion 51 and installation groove 4, the elastic force of elastic member 6 causes the limiting portion 51 to enter the slot 10 and approach fan blade body 2 until the operating portion 52 comes into contact with the side wall of limiting hole 12 to limit the position. The outer surface of operating portion 52 is a serrated friction surface 53, which is convenient for moving the operating portion 52.

The installation groove 4 is provided with a first positioning portion 42, the side of limiting portion 51 facing away from the root 20 is provided with a second positioning portion 54, the elastic member 6 is a spring, and one end of elastic member 6 is sleeved on the first positioning portion 42 to maintain positioning fit, and the other end of elastic member 6 is sleeved on the second positioning portion 54 to maintain positioning fit. In this embodiment, the first positioning portion 42 is a positioning groove, and the second positioning portion 54 is a positioning protrusion.

A locking position 21 and convex portion 22 are further provided on the side of root 20 of fan blade body 2, and the convex portion 22 and locking position 21 are disposed along the inner end of root 20 toward the outer end. A positioning convex strip 23 is provided on the side of the corresponding root 20 along the insertion direction of root 20, and the positioning convex strip 23 avoids the locking position 21 and is inserted into guide groove 11 to guide root 20 into the slot (10). In this embodiment, the number and position of positioning protrusions 23 are set corresponding to the guide grooves 11 of the slot 10.

There are two states between the fan blade body 2 and locking device 3.

First state: When the fan blade body 2 is connected to the turntable 1, the positioning protrusion 23 is aligned to insert into the guide groove 11, so that the root 20 is smoothly inserted into the slot 10. The root 20 is inserted into the slot 10, the convex portion 22 comes into contact with the limiting portion 51, and along with the insertion of root 20, the convex portion 22 causes the locking position 51 to exit the slot 10 and retract into installation groove 4, and compress elastic member 6 until the convex portion 22 disengages from the limiting portion 51, and the elastic force of elastic member 6 causes the limiting portion 51 to be inserted into the locking position 21. The locking device 3 and the fan blade body 2 are mutually locked and limited, and at the same time, the locking device 3 applies force to the fan blade body 2 on the side opposite to locking device 3 through the locking position 21, and the fan blade body 2 is in contact with the slot 10 in the direction away from the locking device 3.

In this embodiment, the locking device 3 causes the positioning protrusion 23 to be in contact with the guide groove 11 on the side away from the locking device 3. The fan blade body 2 and turntable 1 are fixedly connected in this way, and the fan blade body 2 moves outward under the action of external force (such as centrifugal force), the rotating member 5 cannot move because of the restriction by the limiting portion 51 and elastic member 6, that is, the limiting portion 51 remains stuck in the locking position 21, the root 20 is locked in the slot 10, and the fan blade body 2 and turntable 1 are fixedly connected.

The second state: when the fan blade body (2) is separated from the turntable (1), the user pulls the operating portion 52, and the operating portion 52 moves from one side wall of limit hole 12 towards the other side wall, that is, towards the direction of fan blade body 2. Operating portion 52 drives limiting portion 51 to rotate through rotating member 5, that is, the limiting portion 51 exits the slot 10 to retract into the installation groove 4 and to overcome the elastic force of elastic member 6, and after the limiting portion 51 disengages from the locking position 21, the root 20 can be directly disengaged from the slot 10. When the operating portion 52 is released, the elastic member 6 pushes locking device 3 to reset, that is, limiting portion 51 enters the slot (10) from installation groove 4 until the operating portion 52 is in contact with the side wall of limit hole 12.

The fan blade body 2 and turntable 1 of the present invention can be simply, easily and quickly installed without the use of.

As shown in FIG. 1, the present invention also discloses a fan using a fan blade quick installation structure. Fans include but are not limited to ceiling fans, turbofans, etc.

What is claimed is:

1. A fan blade quick installation structure, comprising:

a turntable (1), a fan blade body (2), the turntable (1) is provided with a slot (10) which has an opening end on the edge be turntable (1), a rotatable locking device (3) is provided inside the turntable (1) adjacent to the slot (10), one end of the rotatable locking device (3) extends out of the turntable (1) forming an operating portion (52) a protrusion (22) is formed on the outer edge of the root portion (20) of the fan blade body (2), a sidewall of the protrusion (22) forms a locking slot (21), and there are two configurational states between the fan blade body (2) and the locking device (3);

the first configurational state: when the fan blade body (2) is connected to the turntable (1), the root portion (20) is inserted into the slot (10), the locking device (3) and the locking slot (21) mutually limit each other locking the root portion (20) in the slot (10);

the second configurational state: when the fan blade body (2) is separated from the turntable (1), external force drives the operating portion (52) to rotate the locking device (3), so that the locking device (3) disengages from the locking slot (21), the root portion (20) detaches from the slot (10) releasing the operating portion (52) and resetting the locking device (3), the locking device (3) further comprises a rotating member (5) and an elastic member (6), the rotating member (5) and the turntable (1) are rotatably connected, one end of the rotating member (5), forms a limiting portion (51) and the other end of the rotating member (5) forms the operating portion (52), the limiting portion (51) and the locking slot (21) are mutually limited in the first configurational state, meanwhile the two ends of elastic member (6) respectively touch and apply pressure to the limiting portion (51) and the turntable (1), the elastic member (6) pushes the limiting portion (51) to enter the slot (10) and approach fan blade body (2) until the operating portion (52) touches the turntable (1) and is stopped by the turntable (1).

2. The fan blade quick installation structure according to claim 1, wherein the turntable (1) is provided with an installation groove (4) adjacent to the slot (10), the locking device (3) is rotatably installed in the installation groove (4), and the elastic force of elastic member (6) pushes limiting portion (51) to enter the slot (10) from the installation groove (4), or the limiting portion (51) overcomes the elastic force of elastic member (6) and retracts back into the installation groove (4) from the slot (10) when driving the operating portion (52).

3. The fan blade quick installation structure according to claim 2, wherein a limiting hole (12) is provided on the circumferential surface of turntable (1) corresponding to the installation groove (4), the operating portion (52) extends out of the turntable (1) through the limiting hole (12), and when the elastic force of elastic member (6) causes the limiting portion (51) to enter the slot (10) from the installation groove (4) until the operating portion (52) is in contact with a side wall of the limiting hole (12), the operating portion (52) moves towards the other side wall of the limiting hole (12) to drive the rotating member (5) to rotate, so that the limiting portion (51) overcomes the elastic force of elastic member (6) and returns into the installation groove (4) from the slot (10).

4. The fan blade quick installation structure according to claim 2, wherein the installation groove (4) is provided with a first positioning portion (42), the side of limiting portion (51) facing away from the root portion (20) is provided with a second positioning portion (54), the elastic member (6) is a spring, and one end of elastic member (6) is sleeved on the first positioning portion (42) to maintain positioning fit, and the other end of elastic member (6) is sleeved on the second positioning portion (54) to maintain positioning fit.

5. The fan blade quick installation structure according to claim 2, wherein the turntable (1) is provided with a hollow part (13) adjacent to the installation groove (4), the installation groove (4) is provided with a positioning screw (41), the rotating member (5) is provided with a through hole (50), the rotating member (5) is sleeved on the positioning screw (41) through the through hole (50), a nut (7) and the positioning screw (41) are connected with threads, and the nut (7) confines the rotating member (5) to the positioning screw (41), and the rotating member (5) rotates around the positioning screw (41).

6. The fan blade quick installation structure according to claim 1, wherein when the root portion (20) is inserted into the slot (10), the protrusion (22) contacts the limiting portion (51), as the root portion (20) is inserted, the protrusion (22) causes the locking position (51) to exit the slot (10) until the protrusion (22) and the limiting portion (51) are disengaged, and the elastic force of elastic member (6) causes the limiting portion (51) to be inserted into the locking slot (21).

7. The fan blade quick installation structure according to claim 1, wherein in the first configurational state, the locking device (3) applies force to the locking slot (21), meanwhile the fan blade body (2) contacts the slot (10) in the direction away from the locking device (3).

8. The fan blade quick installation structure according to claim 7, wherein a set of guide grooves (11) are provided on the side of slot (10) along the insertion direction of root portion (20), and the guide grooves (11) avoid the locking device (3), a set of positioning convex strips (23) are provided on the corresponding side of the root portion (20) along the insertion direction of root portion (20), and the positioning strips (23) avoid the locking slot (21) and are inserted into the guide grooves (11) to guide the root portion (20) into the slot (10), the locking device (3) makes the positioning strips (23) contact the guide groove (11) in the direction away from the locking device (3).

* * * * *